US007240634B1

(12) United States Patent
Hoge, Jr.

(10) Patent No.: US 7,240,634 B1
(45) Date of Patent: Jul. 10, 2007

(54) FOLDABLE RIGID FRAME ATTACHMENT SYSTEM FOR PORTABLE INFLATABLE PONTOON BOATS

(75) Inventor: Cecil C. Hoge, Jr., Setauket, NY (US)

(73) Assignee: Harrison Hoge Industries, Inc., Port Jefferson, NY (US)

( * ) Notice: Subject to any disclaimer, the term of this patent is extended or adjusted under 35 U.S.C. 154(b) by 0 days.

(21) Appl. No.: 11/414,549

(22) Filed: May 1, 2006

(51) Int. Cl.
*B63B 7/00* (2006.01)

(52) U.S. Cl. ..... 114/345; 114/61.1; 441/40

(58) Field of Classification Search ..... None
See application file for complete search history.

(56) References Cited

U.S. PATENT DOCUMENTS

| | | | | |
|---|---|---|---|---|
| 155,710 | A | | 10/1874 | Colvin |
| 338,450 | A | | 3/1886 | Urann |
| 1,715,312 | A | | 5/1929 | Steele |
| 2,916,748 | A | | 12/1959 | Stahmer |
| 3,307,209 | A | | 3/1967 | Jackman |
| 3,566,425 | A | | 3/1971 | Welty |
| 3,608,112 | A | | 9/1971 | Irgens |
| 3,812,805 | A | | 5/1974 | Forssell et al. |
| 4,231,131 | A | | 11/1980 | Young |
| 4,348,971 | A | | 9/1982 | Montgomery |
| 4,449,473 | A | | 5/1984 | McCrory et al. |
| 4,660,497 | A | | 4/1987 | Cochran |
| 4,779,555 | A | * | 10/1988 | Hong ..... 114/345 |
| 4,782,777 | A | | 11/1988 | Sussman |
| 4,909,177 | A | | 3/1990 | Jones |
| 4,915,047 | A | | 4/1990 | Lord et al. |
| 4,936,242 | A | | 6/1990 | Stelniceanu |
| 4,938,162 | A | | 7/1990 | Hanlon |
| 4,942,838 | A | | 7/1990 | Boyer et al. |
| 4,976,213 | A | * | 12/1990 | Smith ..... 114/345 |
| 5,013,270 | A | * | 5/1991 | Walls ..... 114/61.1 |
| 5,088,434 | A | | 2/1992 | Harding |
| 5,174,232 | A | | 12/1992 | Boddy |
| 5,290,196 | A | | 3/1994 | Steel |
| 5,651,706 | A | | 7/1997 | Kasper |
| 5,711,240 | A | | 1/1998 | Baker |
| 5,870,966 | A | | 2/1999 | Christian |
| 5,878,688 | A | | 3/1999 | Merrett et al. |
| 6,083,062 | A | | 7/2000 | Treloar et al. |
| 6,131,532 | A | | 10/2000 | Winner et al. |
| 6,173,671 | B1 | | 1/2001 | Casull |
| 6,343,560 | B1 | | 2/2002 | Myers |
| 6,508,194 | B2 | | 1/2003 | Myers |

(Continued)

*Primary Examiner*—Lars A. Olson
(74) *Attorney, Agent, or Firm*—Staas & Halsey LLP

(57) ABSTRACT

A foldable rigid frame attachment system for portable, inflatable pontoon boats including first and second inflatable elongated pontoons arranged to be approximately parallel to each other. The pontoons include pairs of upwardly extending strips formed in a longitudinal direction on both sides of the centerline on the top of each of the pontoons. Transversal slats connect the pontoons, and the bottom of each slat includes engaging means to engage the strips of the pontoons. The pontoon boat is held rigid by first and second underbars. The first underbar is positioned in a longitudinal direction on the top of the first pontoon in between the pairs of strips and below the slats, the second underbar is positioned in a longitudinal direction on the top of the second pontoon in between the pairs of strips and below the slats. As the pontoon boat is inflated, the underbars are locked into position between the pontoons and the slats.

21 Claims, 6 Drawing Sheets

U.S. PATENT DOCUMENTS 6,526,904 B2 3/2003 Liston et al.
6,615,762 B1 9/2003 Scott
6,640,741 B1 11/2003 Myers
6,644,229 B1 * 11/2003 Davenport ..... 114/61.1
6,691,633 B1 2/2004 Metzger et al.
6,810,827 B2 * 11/2004 Hansen ..... 114/345
6,832,571 B2 12/2004 Eagles
7,024,748 B2 4/2006 Eagles
2002/0073909 A1 6/2002 Liston et al.
2002/0129756 A1 9/2002 Myers
2002/0134296 A1 9/2002 Stewart
2003/0056705 A1 3/2003 Johnson, Sr.
2004/0213654 A1 10/2004 Paxton
2004/0244669 A1 12/2004 Boudeau et al.
2005/0034649 A1 2/2005 Rocha
2005/0145158 A1 7/2005 Boudeau et al.

* cited by examiner

FOLDABLE RIGID FRAME ATTACHMENT SYSTEM FOR PORTABLE INFLATABLE PONTOON BOATS

BACKGROUND OF THE INVENTION

1. Field of the Invention

The present invention relates to watercraft, and more particularly, to a foldable rigid frame attachment system for portable, inflatable pontoon boats.

2. Description of the Related Art

Small watercraft are used for a number of activities such as fishing, rowing, sailing, rafting, paddling, motoring and recreational boating. Part of the popularity of small watercraft is that they may be removed from the water after use and then may be transported, thus not requiring dock or slip space. However, even small watercraft may require a trailer to transport and then further require considerable storage space when not in use.

One type of small watercraft especially preferred by fishermen is the pontoon boat. A pontoon boat typically includes two pontoons forming a twin-hull catamaran with a number of slats and a metal framework connecting the two pontoons that also serve as a deck for the user. Pontoon boats are preferred by fishermen because of their stability and shallow draft.

Some disadvantages of conventional pontoon boats include that the pontoons may have hard hulls, often including a filling such as foam, making them cumbersome to transport and store. Pontoon boats having inflatable hulls typically utilize a thin inflatable bladder having a heavy, porous outer bag that causes sluggish maneuverability in the water and further creates a breeding ground for mold and bacteria.

In a conventional pontoon boat, the pontoons are held together by a metal framework that is either welded together, making the pontoon boat impossible to disassemble, or the framework is secured by numerous nuts and bolts that require considerable time to assemble and disassemble. Further, the metal framework usually only provides for a limited number of slats acting as a deck for the user to fish from or perform other recreational activities. As such, dropped objects such as fishing lures or sunglasses that fall between the slats may be irretrievably lost. Due to these problems and others, a portable pontoon boat is desired.

SUMMARY OF THE INVENTION

To solve the above and/or other problems, the present invention provides a portable pontoon boat having inflatable pontoons and a structure that requires no nuts or bolts and is therefore simple and very fast to assemble.

According to an aspect of the invention, the pontoon boat includes first and second inflatable elongated pontoons arranged to be approximately parallel to each other and separated by a predetermined distance; a plurality of pairs of upwardly extending strips formed in a longitudinal direction on both sides of a centerline of a top of the first and second pontoons; a plurality of transversal slats connecting the first pontoon to the second pontoon, a bottom of each slat including engaging means for engaging the strips of the first and second pontoons, a number of the plurality of slats being equal to a number of the plurality of pairs of strips; and first and second underbars, the first underbar being positioned in a longitudinal direction on the top of the first pontoon in between the pairs of strips and below the slat, and the second underbar being positioned in a longitudinal direction on the top of the second pontoon in between the pairs of strips and below the slat.

Additional aspects and/or advantages of the invention will be set forth in part in the description which follows and, in part, will be apparent from the description, or may be learned by practice of the invention.

The pontoon boat may include a flexible dowel formed longitudinally on an uppermost part of the strip, and the engaging means may include a seat hook dimensioned and configured to secure the dowel.

The first and second pontoons are constructed of polyester fabric and, further, each pontoon includes an air valve.

The first and second pontoons each includes a tapered fore and aft end; a molded nose cone attached to each of the tapered fore and aft end; and four optional skegs, one skeg attached to a bottom side of the fore and aft end of each of the first and second pontoons.

The pontoon boat may include a bow bar footrest extending between the first and second pontoons at a forward end of the pontoon boat.

The pontoon boat may include a bench stepboard extending between the first and second pontoons at a forward end of the pontoon boat.

The slats and the underbars may be aluminum. The slats may also include at least one fishing rod holder, a bracket for releasably attaching a chair, and/or a transom.

Each of the first and second underbars may include two or more sections.

A flexible floor may extend between the first pontoon and the second pontoon, the floor being positioned below the slats and connected to an inboard side of the first pontoon and an inboard side of the second pontoon.

A plurality of floor segments may be removably attached to a fore and aft side of successive slats, wherein each floor segment covers an open space between the slats.

According to another aspect of the present invention, there is a method of assembling a pontoon boat, the pontoon boat including first and second inflatable pontoons, the pontoons being connected to each other by a plurality of transversal slats, each slat being connected to the pontoon by a pair of upwardly extending strips formed in a longitudinal direction on both sides of a centerline of a top of the first and second pontoons, the method including: unrolling the pontoon boat so that the pontoons are substantially flat; inserting one or more underbars along a top of each pontoon so that the underbar is positioned in between the strips and below the slats; and inflating the pontoons with air so that the one or more underbars are secured between the top of the pontoons and the bottom of the slats.

The first and second pontoons may each be inflated through an air valve.

A bow bar footrest may be extended between the first and second pontoons at a forward end of the pontoon boat.

At least one fishing rod, chair and or transom may be removably attached to the slats.

A flexible floor may be connected between the first pontoon and the second pontoon, the floor being positioned below the slats and connected to an inboard side of the first pontoon and an inboard side of the second pontoon.

A plurality of flexible floor segments may be removably attached between a fore and aft side of successive slats, wherein each floor segment covers an open space between the slats.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
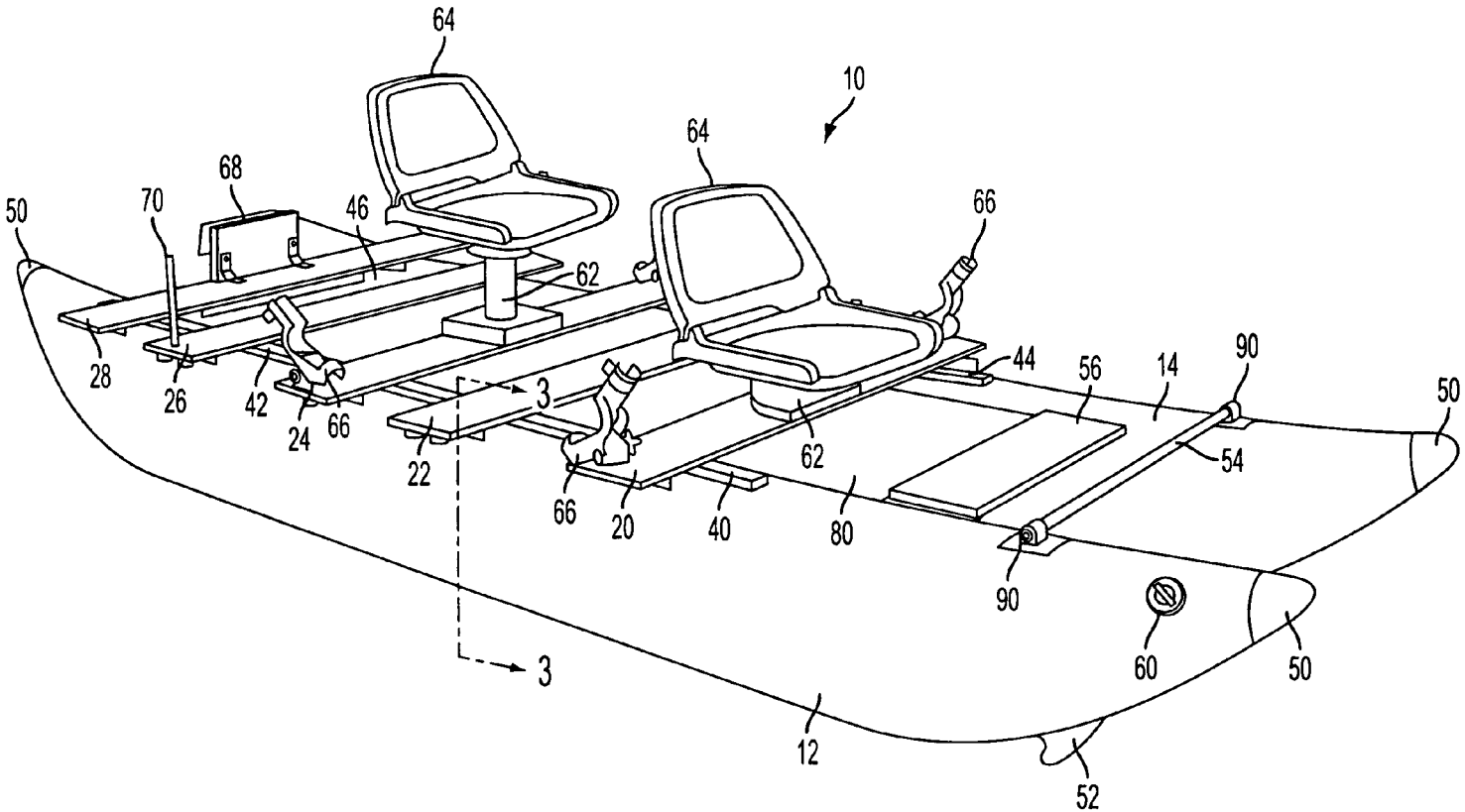
FIG. 1 is a perspective view of an inflated pontoon boat in accordance with an embodiment of the present invention.
Figure 2:
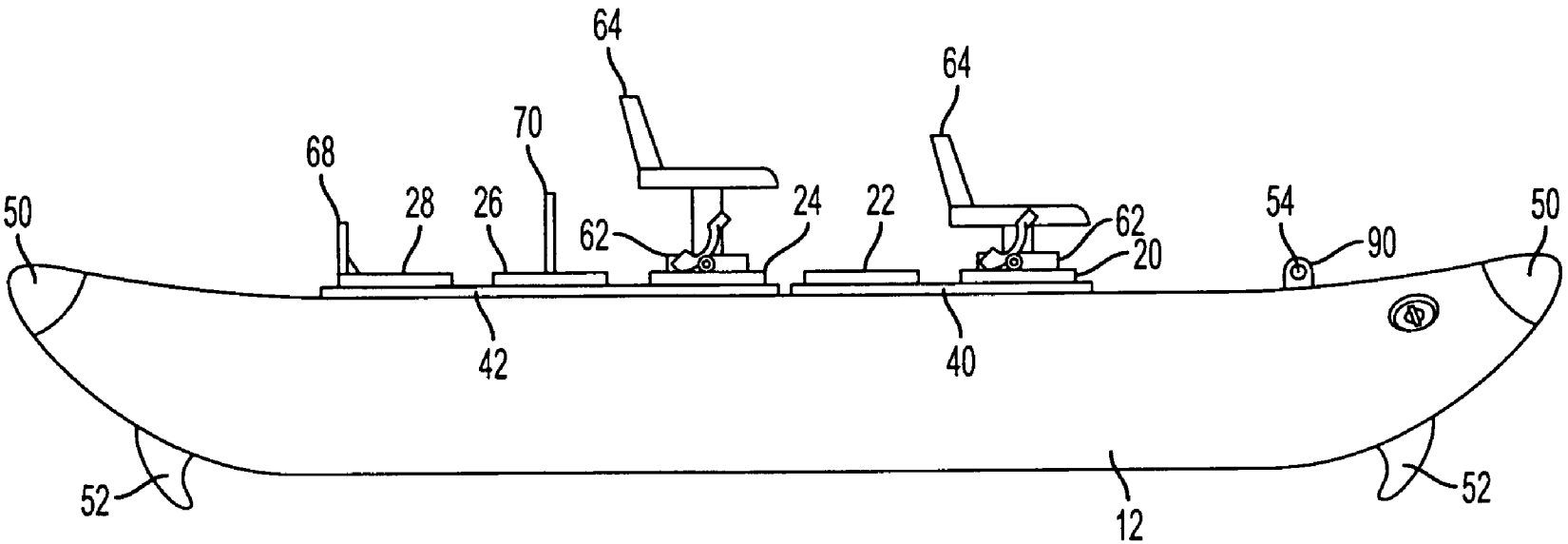
FIG. 2 is a side view of an inflated pontoon boat in accordance with an embodiment of the present invention.

Reference will now be made in detail to the embodiments of the present invention, an example of which is illustrated in the accompanying drawings, wherein like reference numerals refer to like elements throughout. The embodiments are described below to explain the present invention by referring to the annexed drawings.

FIGS. 1-4 show a portable pontoon boat in accordance with an embodiment of the present invention. As shown in FIG. 1, the pontoon boat, generally designated by the reference numeral 10, includes first and second inflatable elongated pontoons 12, 14 arranged to be approximately parallel to each other and separated by a predetermined distance. Pairs of upwardly extending strips 16 (see FIG. 3) are formed in a longitudinal direction on both sides of a centerline of the top of the first and second pontoons 12, 14. Five transversal slats 20, 22, 24, 26, 28 connect the first pontoon 12 to the second pontoon 14. Although five slats are shown, it is understood that any number of slats may be employed in accordance with embodiments of the present invention. The bottom of each of the slats 20, 22, 24, 26, 28 includes engaging means 30 for engaging the strips of the first and second pontoons 12, 14. The number of slats is equal to the number of pairs of strips 16.

Figure 3:
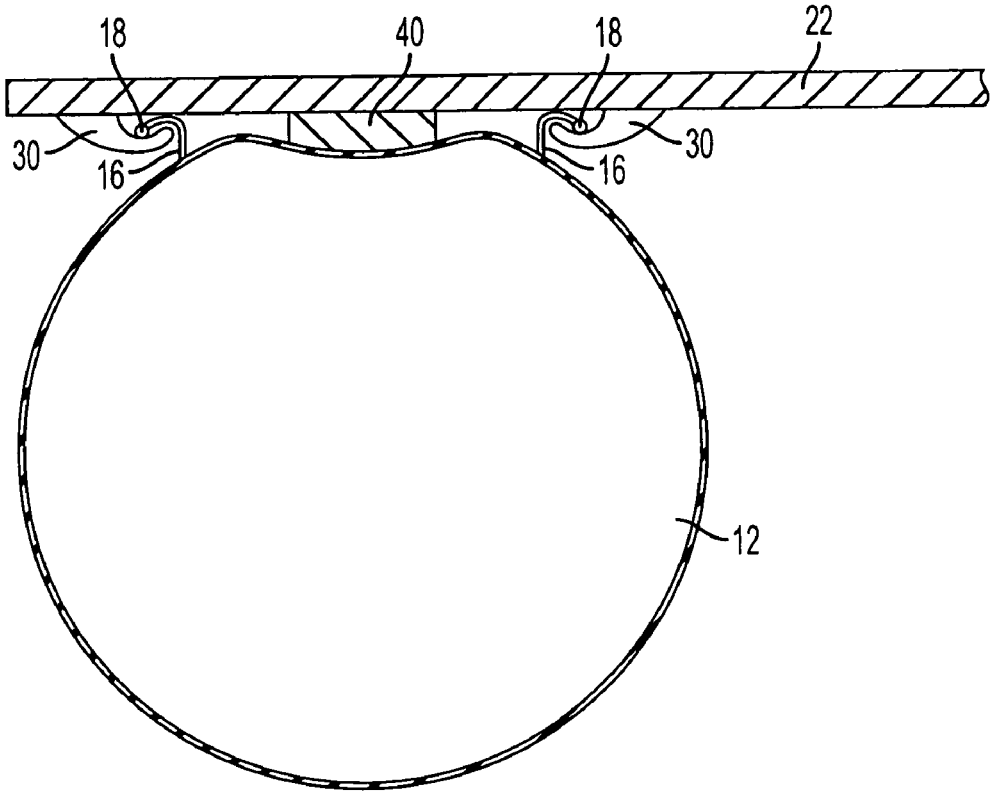
FIG. 3 is a front sectional view taken along lines 3-3' in FIG. 1 of the engaging means of the pontoon boat in accordance with the embodiment of the present invention.
Figure 4:
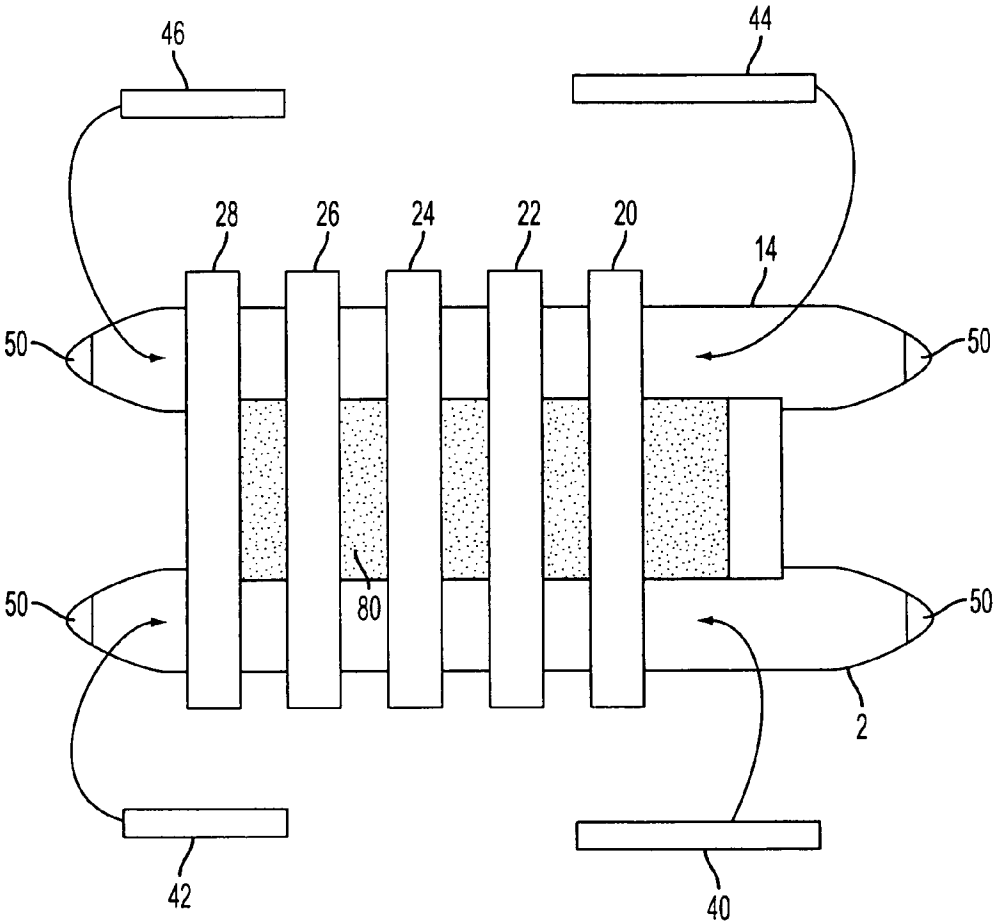
FIG. 4 is a top view of a deflated pontoon boat in accordance with the embodiment of the present invention.

In order to maintain rigidity of the pontoon boat 10, when the pontoons 12, 14 are in a deflated state (as shown in FIG. 4) a first underbar 40, 42 is positioned in a longitudinal direction on the top of the first pontoon 12 in between the pairs of strips 16 and below the slats 20, 22, 24, 26, 28. The second underbar 44, 46 is positioned in a longitudinal direction on the top of the second pontoon 14 in between the pairs of strips 16 and below the slats. In the embodiment of the present invention shown in FIGS. 1-4 the first underbar is broken into two sections 40, 42 and the second underbar is broken into two sections 44, 46. It is understood that the underbars may be formed as a single section or more than two sections.

As shown in FIG. 3, the strips 16 include a dowel 18 formed longitudinally on an uppermost part of each strip 16. The engaging means 30 is formed as a seat hook dimensioned and configured to secure the dowel 18. A seat hook and a dowel 18 are not the only means contemplated for use with the present invention, however, and any other appropriate means of securing the slats 20, 22, 24, 26, 28 to the strips 18 may be used in accordance with embodiments of the present invention. The strips 16, when secured to the slats 20, 22, 24, 26, 28 not only attach the first and second pontoons 12, 14, they also prevent the pontoons from moving side to side. This effect is further enhanced by the underbars 40, 42, 44, 46, which increase longitudinal and lateral stability.

The first and second pontoons 12, 14 are generally made of 1000 denier polyester fabric but may be made of other stronger or weaker fabric materials. The first and second pontoons 12, 14 further each include an air valve 60, preferably a one-way air valve to prevent blow back during inflation and fast deflation.

The first and second pontoons 12, 14 each include a tapered fore and aft end. A molded nose cone 50 is attached to each of the tapered fore and aft ends. A total of four skegs 52 are attached one apiece to a bottom side of the fore and aft end of each of the first and second pontoons 12, 14. The skegs 52 act as a miniature keel to prevent the pontoon boat 10 from slide slipping and wandering, and further provide for more accurate maneuvering.

The pontoon boat 10 includes a bow bar footrest 54 extending between the first and second pontoons 12, 14 at a forward end of the pontoon boat and acts to provide a fisherman at the front of the pontoon boat 10 extra, supported leg room. The bow bar footrest 54 may be secured to the pontoon boat by, for example, grommets 90 attached to the first and second pontoons 12, 14. The pontoon boat 10 also includes a bench stepboard 56 extending between the first and second pontoons 12, 14 at a forward end of the pontoon boat 10. The stepboard 56 makes it easy to step aboard the pontoon boat 10 and further provides for easier launching of the pontoon boat 10.

The slats 20, 22, 24, 26, 28 and the underbars 40, 42, 44, 46 are made of aluminum, however, other suitable materials may be used. The slats 20, 22, 24, 26, 28 may also be provided with certain additional attachments and features for the user. As shown in FIG. 1, forward most slat 20 and amidships slat 24 both include a chair bracket 62 that may be used to attach a chair 64. A chair bracket 62 for releasably attaching a chair 64 is shown, however other types of chair brackets are contemplated with the present invention. The forward most slat 20 and the amidships slat 24 are further provided with fishing rod holders 66 that are inserted into holes formed in the slats 20, 24. The after most slat 28 is equipped with a transom 68 that may be used for the attachment of an outboard motor. Slat 26 is equipped with oar locks 70 that are inserted into holes formed in the slat 26. Although one arrangement of accessories such as chair brackets 62, chairs 64, fishing rod holders 66, transoms 68 and oarlocks 70 are shown and described, other arrangements are contemplated in accordance with embodiments of the present invention.

A flexible floor 80 extends between the first pontoon 12 and the second pontoon 14. The floor 80 is positioned below the slats 20, 22, 24, 26, 28 and connected to an inboard side of the first pontoon 12 and an inboard side of the second pontoon 14. The floor 80 provides additional useable space in the pontoon boat 10 and prevents objects dropped between the slats 20, 22, 24, 26, 28 from falling into the water.

Figure 5:
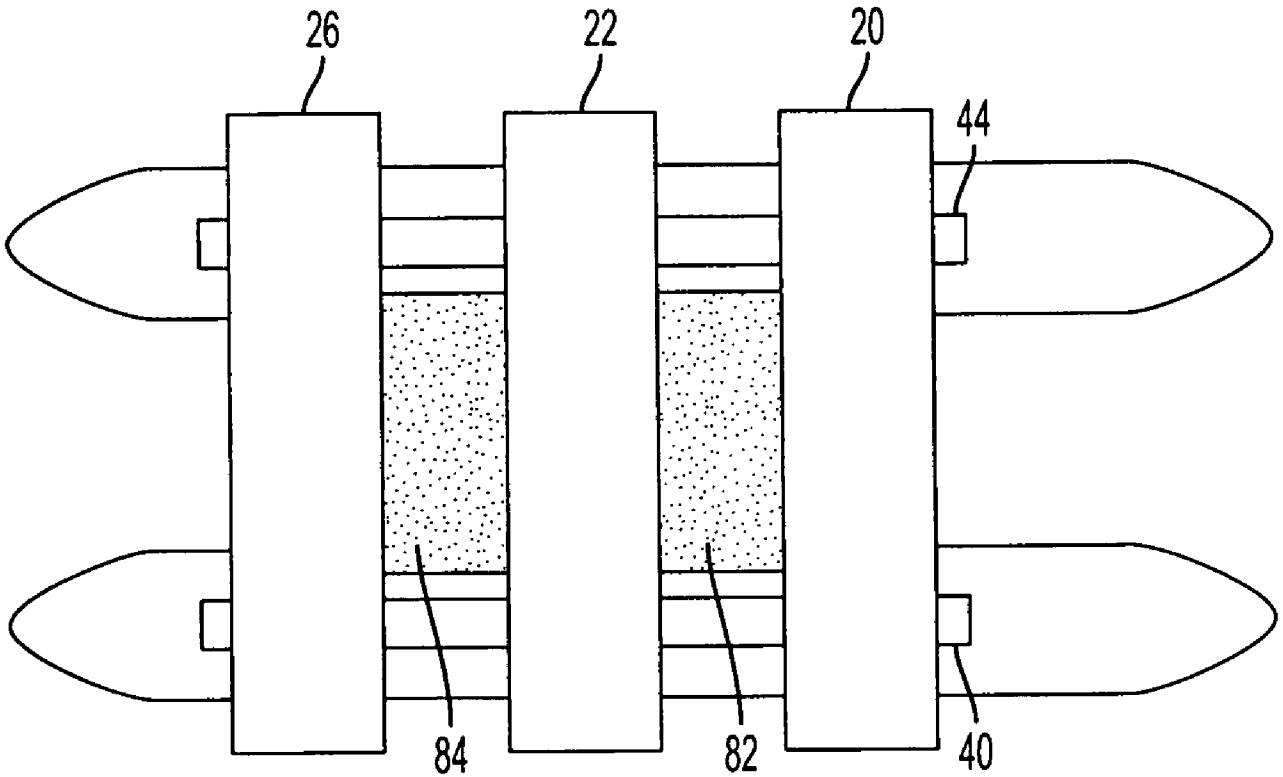
FIG. 5 is a top view of an inflated pontoon boat in accordance with another embodiment of the present invention.
Figure 6:
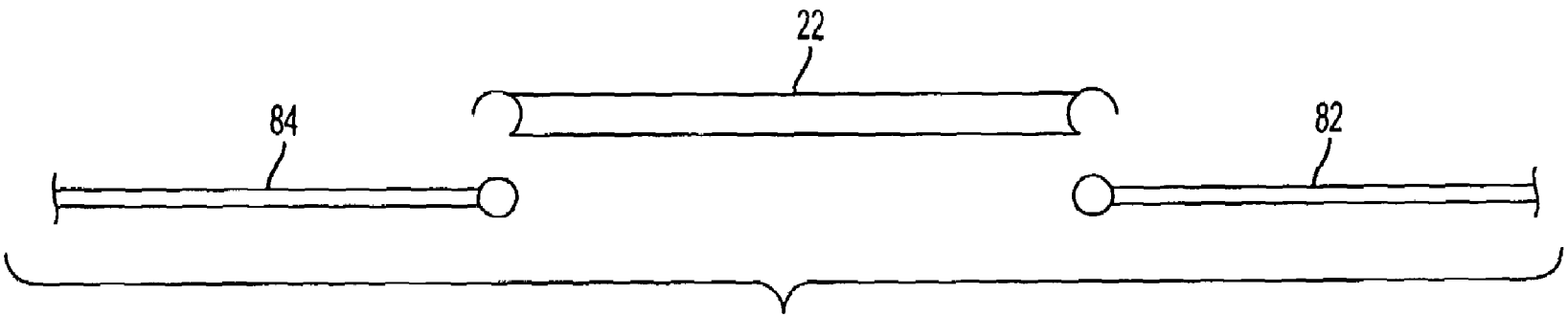
FIG. 6 is a side sectional view of a method of connecting flexible floor segments to the slats in accordance with an embodiment of the present invention.

In another embodiment of a pontoon boat 10 having three slats 20, 22, 24 as shown in FIG. 5, the flexible floor 80 is replaced by a plurality of flexible floor segments 82, 84 that are transversely connected to a fore and aft side of the slats 20, 22, 24, respectively, rather than longitudinally connected to the pontoons 12, 14. The floor segments 82, 84 serve the same purpose as the flexible floor 80, namely to provide additional useable space in the pontoon boat 10 and prevent objects dropped between the slats 20, 22, 24 from falling into the water. FIG. 6 shows one contemplated method of attaching the floor segments 82, 84 to the slat 22. As shown in FIG. 6, each end of the floor segment 82, 84 includes a bead. A fore and aft portion of the slat 22 includes a channel dimensioned and configured to contain the bead.

Assembling the pontoon boat 10 in accordance with embodiments of the present invention is simple, fast, and requires a minimum of work. When the pontoon boat is in a deflated state as shown in FIG. 4, a user unrolls the pontoon boat 10 so that the first and second pontoons 12, 14 are substantially flat. Next, the user inserts the first underbar 40, 42 and the second underbar 44, 46 along a top of each of the first and second pontoons 12, 14, respectively, so that the underbars 40, 42, 44, 46 are positioned in between the strips 16 and below the slats 20, 22, 24, 26, 28. Next, a user inflates the first and second pontoons with air so that as pontoons 12, 14 fill with air, the underbars 40, 42, 44, 46 are secured between the top of the pontoons 12, 14 and the bottom of the slats 20, 22, 24, 26, 28 by the force of the air pressure in the pontoons 12, 14 acting on the underbars 40, 42, 44, 46.

As described, in accordance with embodiments of the present invention, the pontoon boat 10 requires no nuts or bolts. When deflated, the pontoon boat may be rolled and can be stored in a minimum amount of space, for example the trunk of a car.

Although several embodiments of the invention have been shown and described, it would be appreciated by those skilled in the art that changes may be made in these embodiments without departing from the principles and spirit of the invention, the scope of which is defined in the claims and their equivalents.

What is claimed is:

1. A pontoon boat, comprising:

first and second inflatable elongated pontoons arranged to be approximately parallel to each other and separated by a predetermined distance;

a plurality of pairs of upwardly extending strips formed in a longitudinal direction on both sides of a centerline of a top of the first and second pontoons;

a plurality of transversal slats connecting the first pontoon to the second pontoon, a bottom of each slat including engaging means for engaging the strips of the first and second pontoons, a number of the plurality of slats being equal to a number of the plurality of pairs of strips; and first and second underbars, the first underbar being positioned in a longitudinal direction on the top of the first pontoon in between the pairs of strips and below the slat, the second underbar being positioned in a longitudinal direction on the top of the second pontoon in between the pairs of strips and below the slat.

2. The pontoon boat of claim 1, wherein the strip further comprises a dowel formed longitudinally on an uppermost part of the strip and the engaging means comprises a seat hook dimensioned and configured to secure the dowel.

3. The pontoon boat of claim 1, wherein the first and second pontoons are each constructed of polyester fabric and further include an air valve.

4. The pontoon boat of claim 1, wherein the first and second pontoons each further comprises:

a tapered fore and aft end;

a molded nose cone attached to each of the tapered fore and aft end; and four skegs, one skeg attached to a bottom side of the fore and aft end of each of the first and second pontoons.

5. The pontoon boat of claim 1, further comprising a bow bar footrest extending between the first and second pontoons at a forward end of the pontoon boat.

6. The pontoon boat of claim 1, further comprising a bench stepboard extending between the first and second pontoons at a forward end of the pontoon boat.

7. The pontoon boat of claim 1, wherein the slats are aluminum.

8. The pontoon boat of claim 1, wherein the slats include at least one fishing rod holder.

9. The pontoon boat of claim 1, wherein the slats include a bracket for a chair.

10. The pontoon boat of claim 1, wherein the slats include a transom.

11. The pontoon boat of claim 1, wherein each of the first and second underbars comprises two or more sections.

12. The pontoon boat of claim 1, wherein the first and second underbars are aluminum.

13. The pontoon boat of claim 1, further comprising a flexible floor extending between the first pontoon and the second pontoon, the floor being positioned below the slats and connected to an inboard side of the first pontoon and an inboard side of the second pontoon.

14. The pontoon boat of claim 1, further comprising a plurality of floor segments removably attached to a fore and aft side of successive slats, wherein each floor segment covers an open space between the slats.

15. A method of assembling a pontoon boat, the pontoon boat including first and second inflatable pontoons, the pontoons being connected to each other by a plurality of transversal slats, each slat being connected to the pontoon by a pair of upwardly extending strips formed in a longitudinal direction on both sides of a centerline of a top of the first and second pontoons, the method comprising:

unrolling the pontoon boat so that the pontoons are substantially flat;

inserting one or more underbars along a top of each pontoon so that the underbar is positioned in between the strips and below the slats; and inflating the pontoons with air so that the one or more underbars are secured between the top of the pontoons and the bottom of the slats.

16. The method of claim 15, wherein the first and second pontoons are each inflated through an air valve.

17. The method of claim 15, further comprising extending a bow bar footrest between the first and second pontoons at a forward end of the pontoon boat.

18. The method of claim 15, further comprising removably attaching at least one fishing rod to the slats.

19. The method of claim 15, further comprising removably attaching a chair to the slats.

20. The method of claim 15, further comprising connecting a flexible floor between the first pontoon and the second pontoon, the floor being positioned below the slats and connected to an inboard side of the first pontoon and an inboard side of the second pontoon.

21. The method of claim 15, further comprising connecting a plurality of flexible floor segments between a fore and aft sides of successive slats, wherein each floor segment covers an open space between the slats.

* * * * *